US005562246A

United States Patent [19]

Smith et al.

[11] Patent Number: 5,562,246

[45] Date of Patent: Oct. 8, 1996

[54] REINFORCED SHIPPING CONTAINER FOR PERSISHABLE PRODUCTS

[76] Inventors: William R. Smith, 304 Swedesford Rd., Frazer, Pa. 19355; Alfred F. Caggiano; Alfred F. Caggiano, Jr, both of 415 Greenwich Rd., Bridgeton, N.J. 08302

[21] Appl. No.: 489,533

[22] Filed: Jun. 12, 1995

[51] Int. Cl.[6] ..... B65D 5/32; B65D 21/032

[52] U.S. Cl. ..... 229/23 R; 229/125; 229/919

[58] Field of Search ..... 229/23 R, 125, 229/915, 919

[56] References Cited

U.S. PATENT DOCUMENTS

| | | | |
|---|---|---|---|
| 2,723,797 | 11/1955 | Wasyluka | 229/23 R |
| 3,111,254 | 11/1963 | Thyen | 229/915 |
| 3,229,888 | 1/1966 | Gilliam | 229/125 |
| 3,713,579 | 1/1973 | Chaffers | 229/23 R |
| 3,905,541 | 9/1975 | Paxton | 229/23 R |
| 3,935,991 | 2/1976 | Crane | 229/125 |
| 4,053,098 | 10/1977 | Baptist | 229/23 R |
| 4,389,013 | 6/1983 | Hall et al. | 229/915 |
| 5,116,290 | 5/1992 | Ross | 229/915 |
| 5,263,636 | 11/1993 | Aure | 229/919 |
| 5,335,844 | 8/1994 | Young | 229/23 R |

FOREIGN PATENT DOCUMENTS

| | | | |
|---|---|---|---|
| 2660623 | 10/1991 | France | 229/125 |

*Primary Examiner*—Gary E. Elkins
*Attorney, Agent, or Firm*—Robert Samuel Smith

[57] ABSTRACT

A container having two side panels, a bottom panel and lid panels all diecut from a single paperboard sheet and two end panels of relatively thick rigid fiberboard opposite one another and joined to edges of the side and bottom panels. The end panels have sufficient strength and are configured such that the containers may be arranged in an accurate stack with the containers interlocked with one another. Each container has a pair of lid panels that fold together to close the container or may be folded back and locked against the side panels by tabs to hold the container open for convenient filling.

10 Claims, 1 Drawing Sheet

REINFORCED SHIPPING CONTAINER FOR PERSISHABLE PRODUCTS

BACKGROUND

1. Field of the Invention

This invention relates to containers or crates such as are required to ship perishable products including fruits, particularly peaches, vegetables, and seafood and particularly to a container that has reinforced end panels that enable the containers to be stacked without being crushed, resist water damage and which are amenable to manufacturing techniques that effect a reduction in manufacturing cost of the container.

2. Prior Art and Information Disclosure

Cellulose materials derived from wood have appeared in many forms such as panels for use in the construction and container industry.

In the construction industry, panels made from post consumer waste product such as newspaper have been used as interior walls of buildings in competition with sheetrock panels. These panels are typically thicker than three eighths of an inch and therefore break when bent. Such panels have a density in the range of 24–26 pounds per cubic foot and a tensile strength ranging from 400 to 700 psi. In the context of this specification, the term "fiberboard panel" will be understood to mean a panel composed of pressed fiber and which is greater than three eighths of an inch thick so that it is rigid. By rigid is meant that it will break when it is bent. A source of such material is the Homasote Co. located in West Trenton, N.J., a company that manufactures panels from recycled news print for the building industry.

In the container industry, cellulose fiber has been used for many years to make paper board panels which are assembled into boxes of many shapes and sizes. The industry commonly uses any one of three types of panels for making containers. One type may be referred to as "solid" paper board which is single ply and is typically a paperboard panel that is less than one eighth inch thick. A second type may be referred to as single wall corrugated paper board and comprises two opposing sheets of "solid" paperboard separated by a corrugation. A third type may be referred to as double wall corrugated paper board and comprises three opposing sheets of "solid" paperboard separated from one another by two corrugated media. In the context of this specification, the term "paperboard" will be understood to mean all of these three types of paperboard panels.

Needs of the Agriculture industry to ship perishable foodstuffs and store them for extended periods of time have lead to the development of specialized containers to meet these needs.

The containers have included the familiar "orange crates" which were strips of wood assembled into a box such that openings between the strips permitted circulation of air and the wooden frame construction of the crate conferred resistance to damage even when the boxes were stacked on one another.

Another development that had a great impact on the shipping of perishables was the introduction of containers assembled from corrugated paperboard impregnated with wax. The wax impregnated corrugated paper board provided resistance to water so that the containers could be located out in the field without concern that they would be damaged by exposure to the weather.

Yet another development in the industry was the appearance of boxes having a wooden frame around the panel edges with paperboard panels forming the sides of the box.

In spite of these advances in the container art, there continues to exist a strong interest in developing ever less expensive and more convenient containers for shipping and storing perishables, particularly fruits, vegetables, and seafood.

THE INVENTION

OBJECTS

It is an object of this invention to provide a container which is especially well adapted for shipping and storing perishables.

It is another object that the container have substantial crush resistance in order that the containers may be arranged in stacks so as to conserve storage space.

It is another object that when the containers are stacked there be air space between the containers so that contents are not crushed by stacking.

It is another object that the container be resistant to degradation due to moisture resulting from containing water laden items such as peaches for long periods of time.

It is another object that the container be amenable to manufacture by manufacturing techniques that are cost effective compared to containers of the present art made for similar purposes.

SUMMARY

This invention is directed toward a container constructed with two opposing end fiber board panels joined by side, bottom and lid panels of corrugated card board. The end panels are constructed of fiber board so as to have a strength which approaches that of a wood panel. The paperboard side, bottom and lid panels are diecut from a single paperboard panel with fold lines and flaps. The container is assembled by gluing flaps of the side and bottom panels to the end panels. In a preferred embodiment, the fiber board selected for making the end panels is such that the end panels can be diecut from sheets of fiberboard so that the containers are substantially less expensive to manufacture than competing containers that are at least partly wood. When the containers are stacked, the end panels have legs that extend below the bottom panel and engage apertures in the lower container so that each container can be accurately stacked and interlocked with the next lower container. The lid panel may be folded back and temporarily locked to facilitate filling the container and then may be folded over to close the container, the container has handholds along the edge of the box.

DISCUSSION OF THE BEST MODES

Figure 1:
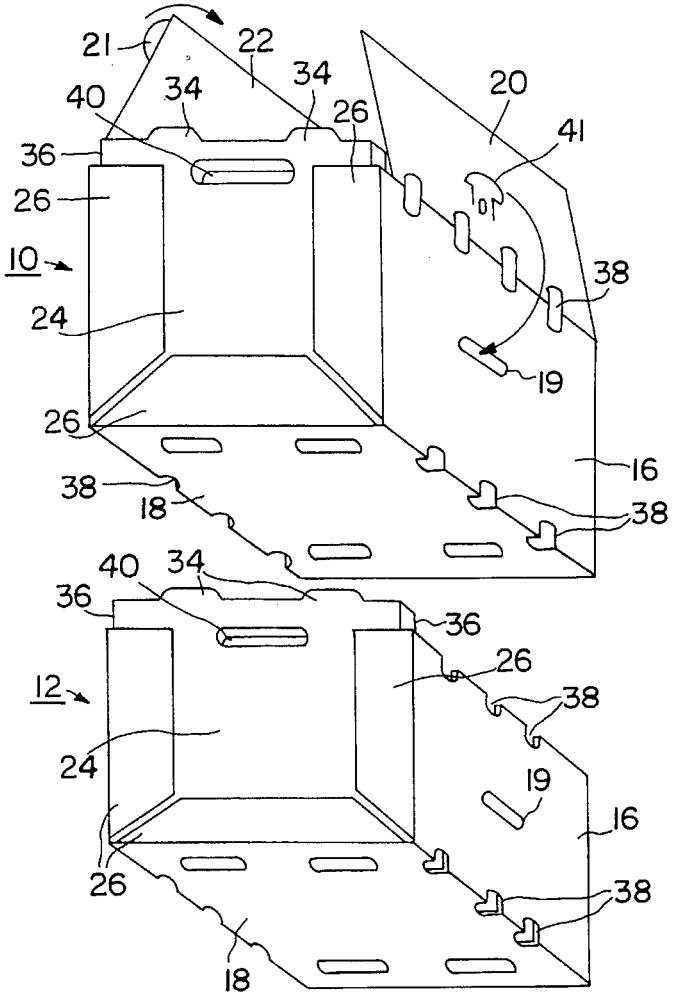
FIG. 1 shows two containers of the invention with one above the other for stacking.

Turning now to a description of the drawings, FIG. 1 is a perspective view of an open container 10 of this invention positioned for stacking on a bottom container 12 of this invention. Each container has two side panels 16 and a bottom panel 18. Each container also has lid panels, 20 and 22, and two end panels 24. Only one end panel 24 is shown in FIG. 1.

Figure 2:
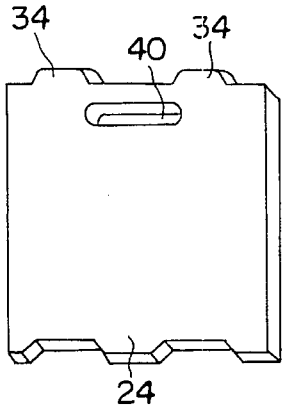
FIG. 2 shows an end panel.

FIG. 2 shows one of the two end panels 24. The end panel 24 is fiberboard that is at least one half inch thick. This selection for the end panel enables the manufacture of the end panel by diecutting from fiberboard. Diecutting is a less expensive procedure than sawing which must be done when constructing containers that are partly wood. An end panel that has sufficient strength such as required for stacking and yet is amenable to manufacturing by diecutting is therefore an important feature of this invention.

A preferred embodiment comprises fiberboard derived from "post consumer waste paper" such as newspaper that has been reduced to pulp by fluidizing in water and then pressed to its final shape and dried. A preferred thickness for the end panel is about one half inch and typically has a tensile strength in the range 450–700 psi and a density of 25 to 30 pounds per cubic foot. An example of fiberboard suitable for this invention is the "440 HOMASOTE™" panel manufactured by the Homasote Co. of West Trenton, N.J.

Figure 3:
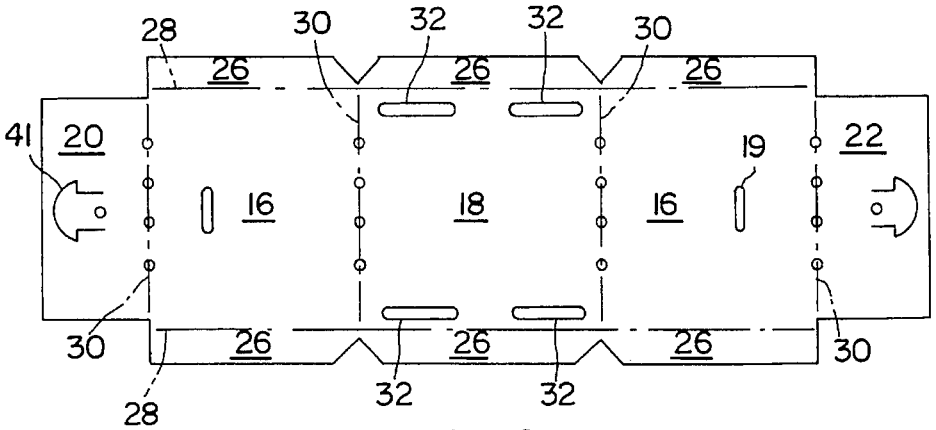
FIG. 3 shows the single panel from which is diecut the side, bottom and lid panels.

FIG. 3 shows a corrugated paperboard panel that has been diecut from a paperboard sheet to form the sides 16 joined to bottom panel 18, and lid. 20 and 22 along fold lines 30. Flaps 26 are also shown which are folded along fold lines 28 presenting a surface which is glued against the end panel 24 of the assembled container as shown in FIG. 1. End panel 24 has recesses 35 along bottom edge 37 enabling four slots 32 in bottom panel 18 to receivingly engage tabs 34 of end panel 24 of the upper container 10 as shown in FIG. 1 when container 10 is stacked on container 12. By this construction, the containers are locked in a straight stack.

End panels 24 extend above side panels 16 as shown at location 36 in FIG. 1. Therefore, when the containers are stacked and the lids 20, 22 are closed, a space is provided between the containers which permits circulation of air between the containers and prevents the top container from crushing the bottom container. Circulation of air is also provided by apertures 38.

The end panels 24 have slots 40 which serve as handholds for lifting the containers.

Figure 4:
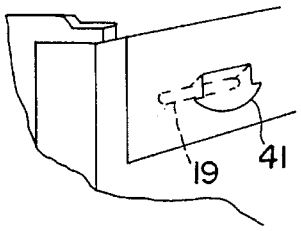
FIG. 4 shows the lid panel folded back and locked for filling the container.

As shown in FIG. 4, the lid panels 20,22, have tabs 41 cut and hinged which are inserted into slots 19 of side panel 16 when lid panels 20,22 are folded back for filling the container thereby facilitating the filling of container 10.

The container described in the foregoing paragraphs meets the objects of this invention. It is a particular feature of this invention that the end panels are made from a fiberboard having a thickness such that it can be manufactured by diecutting yet is sufficiently strong and rigid and configured such as to prevent crushing product inside each container when the containers am stacked. Fold lines defining the sides bottom with flaps and the lid panel member together with the single diecutting step performed on a single paperboard panel is a cost effective process. The arrangement of the lid member also permits locking the lid member in an open position for convenience in filling the container. It is a particular feature of this invention that the end panels are made from a a material that is diecuttable yet sufficiently strong and rigid Variations of this invention may be suggested by reading the specification and studying the drawings which are within the scope of the invention. For example, a number of other fiberboard panels may be considered other than fiberboard derived from newspaper. waste. Additional apertures may be formed in the panels for greater air circulation. The corrugated paperboard panels may be coated with wax to confer water resistance to the panels. The flaps may be secured against the end panels by staples. The lid panel of the container may be a single panel covering the entire opening of the container in place of the pair of lid panels 20 and 22 shown in FIG. 1. The lid panels may have a single tab bent to engage a single slot in the respective side panel when the container is open..In view of these and other modifications, we therefore wish to define my invention by the scope of the appended claims.

We claim:

1. A container which comprises:

two fiberboard end panels being substantially rectangular and having a thickness;

a paperboard panel having a shape with fold lines defining a bottom panel with two bottom panel flaps, two side panels, each with two side panel flaps and a lid panel member;

means for securing each said bottom panel flap to a bottom edge of one of said end panels respectively and each one of said two side panel flaps of each one of said two side panels to one side edge respectively of a pair of side edges of each of said two fiberboard end panels such as to form said container, each said end panel having a top edge opposite said bottom edge and having at least one tab extending away from said top edge and at least one recess along said bottom edge:

said bottom panel having at least one slot;

each one tab of said at least one tab and each one recess of said at least one recess arranged in operable combination with one slot of said at least one slot such that said container is stackable on another identical container with said one slot of said another identical container receivingly engaging said one tab of said container;

said side edges of said end panels having a length that is greater than a length of said side edges of said side panels and each one of said containers operably assembled such that when one of said containers is stacked on another one of said containers with said at least one tab of said one of said containers engaged with said at least one slot respectively of said another one of said containers, a space is formed between said bottom panel of said one of said containers and said lid panel member of said another one of said containers such that said one of said containers and said another one of said containers are adapted to avoid crushing contents of said another one of said containers by a weight of said one of said containers;

said side edges of said end panels having a length that is greater than a length of said side edges of said side panels and each one of said containers operably assembled such that when one of said containers is stacked on another one of said containers with said at least one tab of said one container engaged with said at least one slot respectively of said another container, a space is formed between said bottom panel of said container and said lid panel member of said another identical container such that said one container and said another container are adapted to avoid crushing contents of said another container by a weight of said one container.

2. The container of claim 1 wherein said paperboard panel is coated with wax such as to render said paperboard panel resistant to moisture.

3. The container of claim 1 wherein said fiberboard end panels are made from a fiberboard panel that is rigid and diecuttable.

4. The container of claim 1 wherein said means for securing is an adhesive applied between each said bottom panel flap and an area adjacent to said bottom edge of one of said end panels respectively and between each one of said two side panel flaps of each one of said two side panels to another area adjacent to said one side edge respectively of said pair of said side edges of each of said two side panels.

5. The container of claim 1 wherein said means for securing is an adhesive.

6. The container of claim 1 wherein said means for securing is a plurality of staples.

7. The container of claim 1 where each one of said two end panels have a handhold slot operably arranged to permit a user to lift said container by inserting his fingers into said handhold slots.

8. The container of claim 1 wherein said lid panel member comprises a first lid panel and a second lid panel, said first and second panels each having one edge joined along a fold line of a top edge of one of said two side panels respectively such that said first and second lid panels are enabled to be folded over an open top of said container such as to close said container and folded back against one of said side panel respectively to open said container and fill said container.

9. The container of claim 8 comprising:

said first and second lid panels each having at least one tab extending away from an edge;

each side panel having at least one slot positioned to receivingly engage one of said at least one tab when said first and second lid panels are folded back against said respective side panel such that said container is maintained open when it is required to fill said container.

10. The container of claim 1 wherein said lid panel member is a single lid panel having an edge joined along a folding line to a top edge of one of said side panels.

* * * * *